US005842789A

United States Patent [19]

Derby et al.

[11] Patent Number: 5,842,789

[45] Date of Patent: Dec. 1, 1998

[54] ONE PIECE FLEXIBLE INTERMEDIATE BULK CONTAINER AND PROCESS FOR MANUFACTURING SAME

[75] Inventors: Norwin C. Derby, Dallas; Craig A. Nickell, Sherman; Bobby Glenn Brown, Dennison, all of Tex.

[73] Assignee: Super Sack Mfg. Corp., Dallas, Tex.

[21] Appl. No.: 851,110

[22] Filed: May 5, 1997

Related U.S. Application Data

[63] Continuation of Ser. No. 792,907, Feb. 6, 1997.

[51] Int. Cl.[6] ..... B65D 33/14

[52] U.S. Cl. ..... 383/24; 383/41; 383/67; 383/107; 383/117; 383/17

[58] Field of Search ..... 383/24, 41, 67, 383/105, 107, 117, 17

[56] References Cited

U.S. PATENT DOCUMENTS 4,113,146 9/1978 Williamson .
4,143,796 3/1979 Williamson et al. .
4,224,970 9/1980 Williamson et al. .
4,457,456 7/1984 Derby et al. .
4,479,243 10/1984 Derby et al. .
4,759,473 7/1988 Derby et al. .
4,811,419 3/1989 Derby .
5,076,710 12/1991 Derby .
5,158,367 10/1992 Derby .
5,165,802 11/1992 Derby .
5,203,633 4/1993 Derby .
5,244,281 9/1993 Williamson et al. .

*Primary Examiner*—Jes F. Pascua
*Attorney, Agent, or Firm*—Micheal A. O'Neil

[57] ABSTRACT

A process of manufacturing a bulk bag begins with a tubular blank of woven polypropylene material which is cut along a first transversely extending line 64 to form the upper edges of lift sleeve portions 76, cut along longitudinally extending lines 66 to form the side edges of the lift sleeve portions 76, and cut along substantially transversely extending lines 68 situated at the midpoint of the lines 66 to form opposed top wall halves 72 and opposed bottom wall halves 74. The top wall halves and the bottom wall halves are then sewn together along sew lines 82 and 84, respectively. Sidewalls 70' are joined to the bottom wall halves 74 along sew lines 86, and the top wall halves 72 are joined to the sidewalls 70' along sew lines 88. The lift sleeve portions 76 may be configured to provide lift sleeve, lift rope, or single point lift construction. The top and bottom walls may be provided with a fill chute and discharge chute, respectively.

9 Claims, 13 Drawing Sheets

ONE PIECE FLEXIBLE INTERMEDIATE BULK CONTAINER AND PROCESS FOR MANUFACTURING SAME

RELATED APPLICATION

This application is a continuation-in-part of application Ser. No. 08/792,907 filed Feb. 6, 1997 entitled ONE PIECE FLEXIBLE INTERMEDIATE BULK CONTAINER AND PROCESS FOR MANUFACTURING SAME.

TECHNICAL FIELD

This invention relates to flexible intermediate bulk containers and, more particularly, to bulk containers constructed from a tubular blank of woven fabric and process for manufacturing the same.

BACKGROUND AND SUMMARY OF THE INVENTION

Historically, flexible intermediate bulk containers (bulk bags) have been used for receiving, storing, transporting and discharging flowable materials of all types. Bulk bags are typically constructed in a square, vertically rectangular, or circular shapes with lift straps attached to each of the uppermost corners of the square, rectangle or circle.

By way of example, flexible intermediate bulk containers are used for handling granular, liquid or powder (flowable) materials such as chemicals, minerals, fertilizers, foodstuffs, grains and agricultural products. The advantages of such receptacles include relatively low weight, reduced cost, versatility and, in the case of reusable receptacles, low return freight costs.

At the present time most bulk bags are manufactured from woven polypropylene fabric. Typically, such containers are constructed by stitching or sewing together two or more sidewalls and a bottom wall. Optionally, a top wall and lift straps or other structural support can be added to the basic construction. The traditional method of securing the seams of the several portions of the container includes sewing or stitching.

The instant invention comprises a method of constructing a bulk bag from a tubular blank of woven fabric comprising side, top and bottom walls of which are quickly, easily and inexpensively joined to form the container.

BRIEF DESCRIPTION OF THE DRAWINGS

A more complete understanding of the invention may be had by reference to the following Detailed Description when taken in conjunction with the accompanying Drawings in which.

DETAILED DESCRIPTION

Figure 1A:
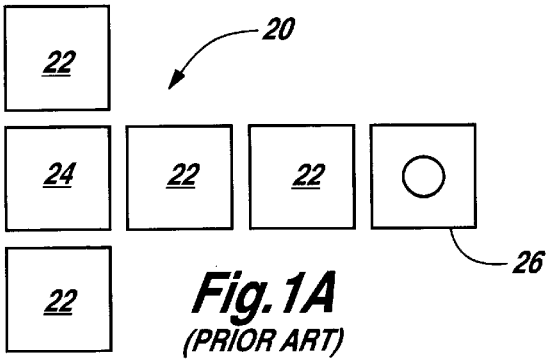
Fig.1A (PRIOR ART)
FIG. 1A is an exploded view of a first prior art bulk bag construction.
Figure 1B:
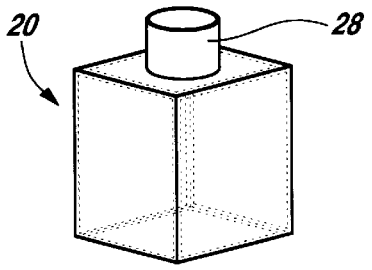
Fig.1B (PRIOR ART)
FIG. 1B is an assembled view of the prior art bulk bag of FIG. 1A.

Referring now to the Drawings wherein like reference characters denote like or similar parts throughout the Figures and particularly to FIGS. 1A and 1B thereof, there is shown a first prior art bulk bag 20. The bulk bag 20 comprises four side panels 22, a bottom panel 24 and a top panel 26. The panels 22, 24 and 26 are sewn one to the other along all four of their respective edges to form the bulk bag 20. As is best shown in FIG. 1B, the resulting bulk bag is in the form of a cube. As is further illustrated in FIG. 1B and as is well known in the art, the bulk bag 20 may be provided with a top chute 28, a similar bottom chute (not shown), lift loops (not shown), lift sleeves (not shown), etc.

Figure 2A:
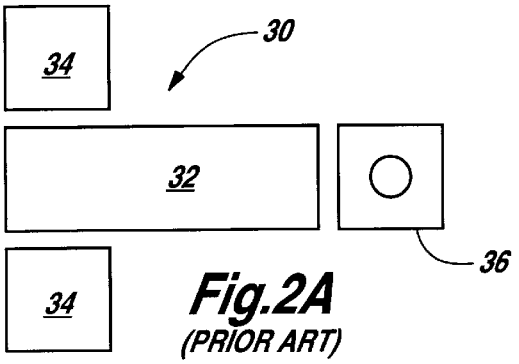
Fig.2A (PRIOR ART)
FIG. 2A is an exploded view of a second prior art bulk bag construction.
Figure 2B:
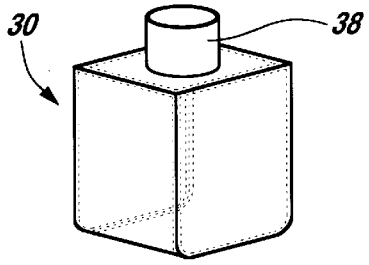
Fig.2B (PRIOR ART)
FIG. 2B is an assembled view of the prior art bulk bag of FIG. 2A.

Referring to FIGS. 2A and 2B, there is shown a second prior art bulk bag 30 of the type commonly referred to as a U-panel bag. The bulk bag 30 comprises an elongate U-panel 32 which forms the bottom and two sides of the bulk bag 30, two side panels 34 and a top panel 36. As is illustrated in FIG. 2B, the panels 32, 34 and 36 are sewn together along all four of their respective edges to form a bulk bag which takes the form of a cube. As is further illustrated in FIG. 2B and as is well known in the art, the bulk bag 30 may be provided with a top chute 38, a similar bottom chute (not shown), lift loops (not shown), lift sleeves (not shown), etc.

Figure 3A:
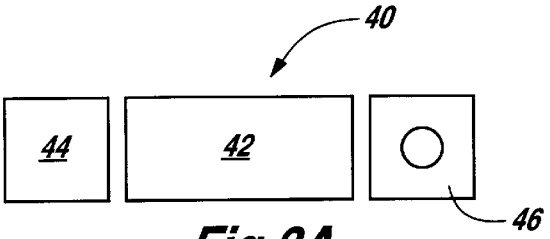
Fig.3A (PRIOR ART)
FIG. 3A is an exploded view of a third prior art bulk bag construction.
Figure 3B:
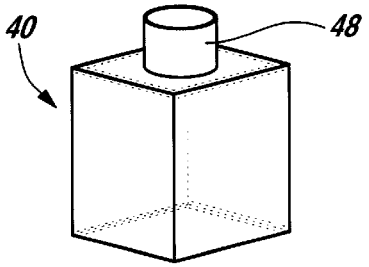
Fig.3B (PRIOR ART)
FIG. 3B is an assembled view of the prior art bulk bag of FIG. 3A.

Referring to FIGS. 3A and 3B, there is shown a third prior art bulk bag 40. The bulk bag 40 comprises a tubular construction 42 which is typically manufactured on a circular loom. The bulk bag 40 further comprises a bottom panel 44 and a top panel 46. In the construction of the bulk bag 40, the tube 42 is joined to the bottom panel 44 and the top panel 46 along the entire peripheries thereof to form the completed bulk bag. Those skilled in the art will appreciate that although the bottom panel 44 and the top panel 46 are illustrated in FIG. 3A as being rectangular in shape, the top panel 46 and bottom panel 44 of the bulk bag 40 need not be of any particular shape, and quite frequently are circular in configuration.

FIG. 3B illustrates the completed bulk bag 40. The bulk bag 40 may be provided with a top chute 48, a similar bottom chute (not shown), lift loops (not shown), lift sleeves (not shown), etc.

Figure 4A:
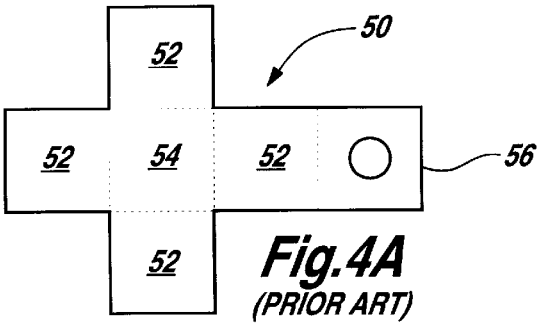
Fig.4A (PRIOR ART)
FIG. 4A is an exploded view of a fourth prior art bulk bag construction.
Figure 4B:
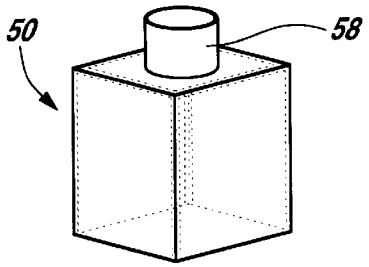
Fig.4B (PRIOR ART)
FIG. 4B is an assembled view of the prior art bulk bag of FIG. 4A.

Referring to FIGS. 4A and 4B, there is shown a fourth prior art bag 50. The bulk bag 50 is formed from a single piece of material which may be considered as being segregated into side panel portions 52, a bottom panel portion 54 and a top panel portion 56. The bulk bag 50 is completed by joining the side panel portions 54 and the top panel portion 56 one to the other along their respective peripheries, preferably by sewing.

As is illustrated in FIG. 4B, the completed bulk bag 50 is in the form of a cube. The bulk bag 50 may be provided with a top chute 58, a similar bottom chute (not shown), lift loops (not shown), lift sleeves (not shown), etc.

Figure 5:
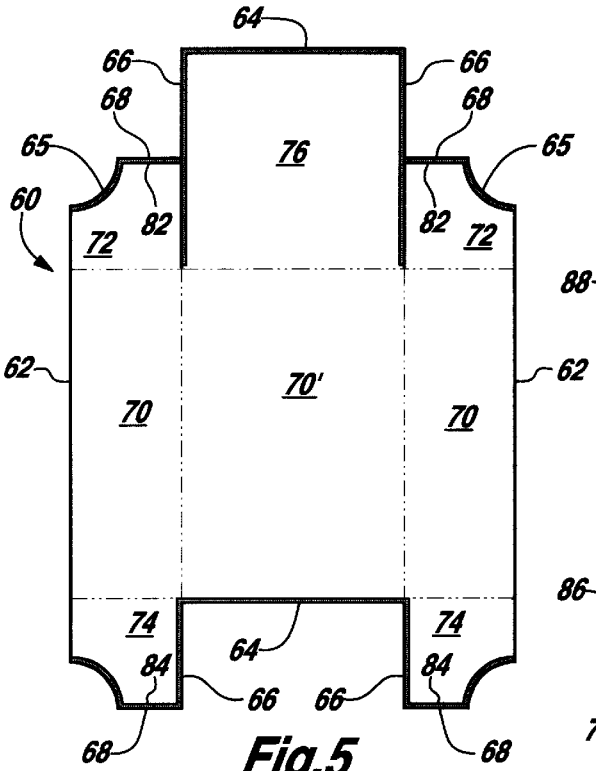
FIG. 5 is an illustration of initial steps in the process of manufacturing the first embodiment of the bulk bag of the present invention.

Referring now to FIG. 5, there is shown the first steps of a process for manufacturing a first embodiment of a bulk bag 60 comprising the present invention. The bulk bag 60 is preferably formed from a length of tubular material, preferably woven polypropylene material. The length of tubular material comprising the bulk bag 60 may conveniently be formed on a circular loom; however, it will be understood that other methods for manufacturing the length of tubular material may be employed in the practice of the invention, if desired. The tubular material may be formed by sewing two sheets of rectangular shaped fabric to one another along their longitudinal edges. Alternatively, a single piece of fabric may be folded in half and the longitudinal edges sewn to one each other.

The process for manufacturing the bulk bag 60 of the present invention begins by laying the length of tubular material flat. Thus, the length of tubular material comprises two layers, one positioned on top of the other, which are joined together along lines 62 comprising folds in the fabric of the tubular material. Next, the length of tubular material is cut along transverse lines 64, longitudinal lines 66 and substantially transverse lines 68 (located at the midpoints of lines 66) to form the configuration illustrated in FIG. 5. Those skilled in the art will appreciate the fact that by making the cuts 64, 66 and 68, the length of tubular material is automatically formed into successive blanks, each comprising one bulk bag 60 incorporating the present invention. Those skilled in the art will further appreciate that various known and unknown methods of cutting may be used in the practice of the present invention. Such methods include, but are not limited to, laser cutting, die cutting, hot cutting, cold roller cutting, ultra-sonic cutting, etc.

Figure 25:
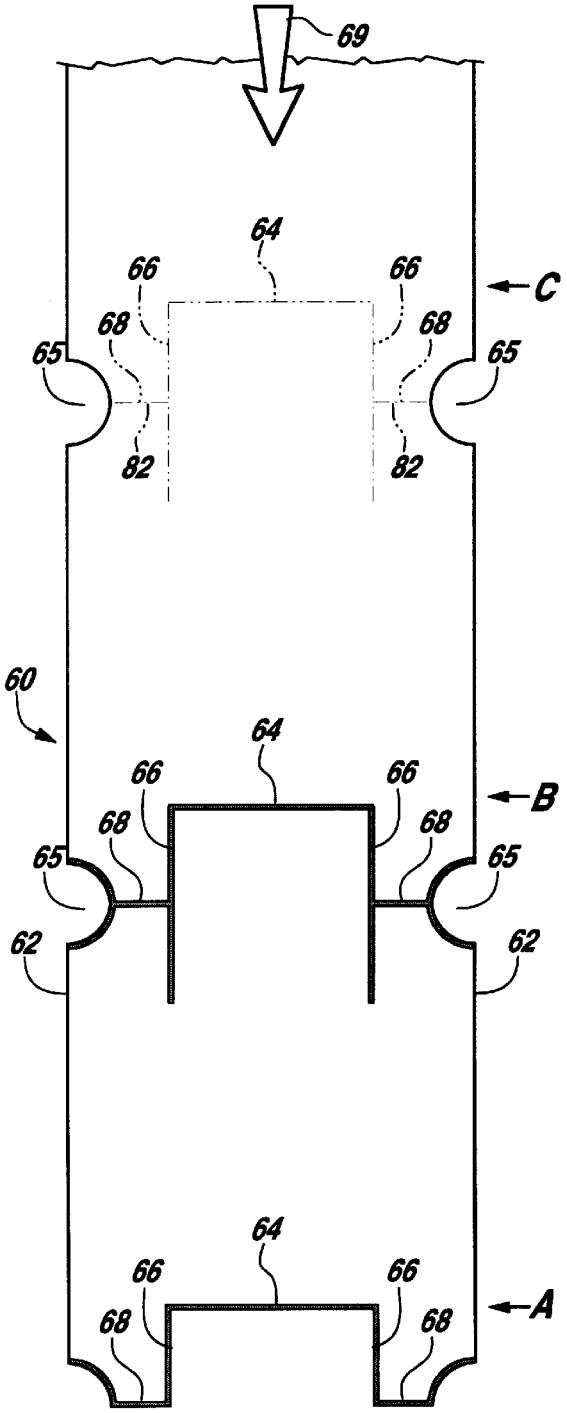
FIG. 25 is a diagrammatic illustrating the process of manufacturing a succession of the bulk bag blanks of the present invention wherein the blank is formed from a continuously woven tube.

The foregoing procedures are further illustrated in FIG. 25. A continuous length of tubular woven polypropylene material formed, for example, on a circular loom, is advanced along a path defined by the arrow 69. Zone A comprises the leading end of a first bulk bag blank comprising previously formed cuts extending along the lines 64, 66 and 68. Zone 2 defines the trailing end of the first bulk bag blank and the leading end of a second bulk bag blank comprising just-completed cuts extending along the lines 64, 66 and 68. Zone C defines the trailing end of the second bulk bag blank and the leading end of a third bulk bag blank comprising yet-to-be-formed cuts extending along the lines 64, 66 and 68. Thus, it will be understood that the process of bulk bag manufacture comprising the present invention produces a succession of bulk bag blanks while generating a minimal amount of scrap material.

Figure 26:
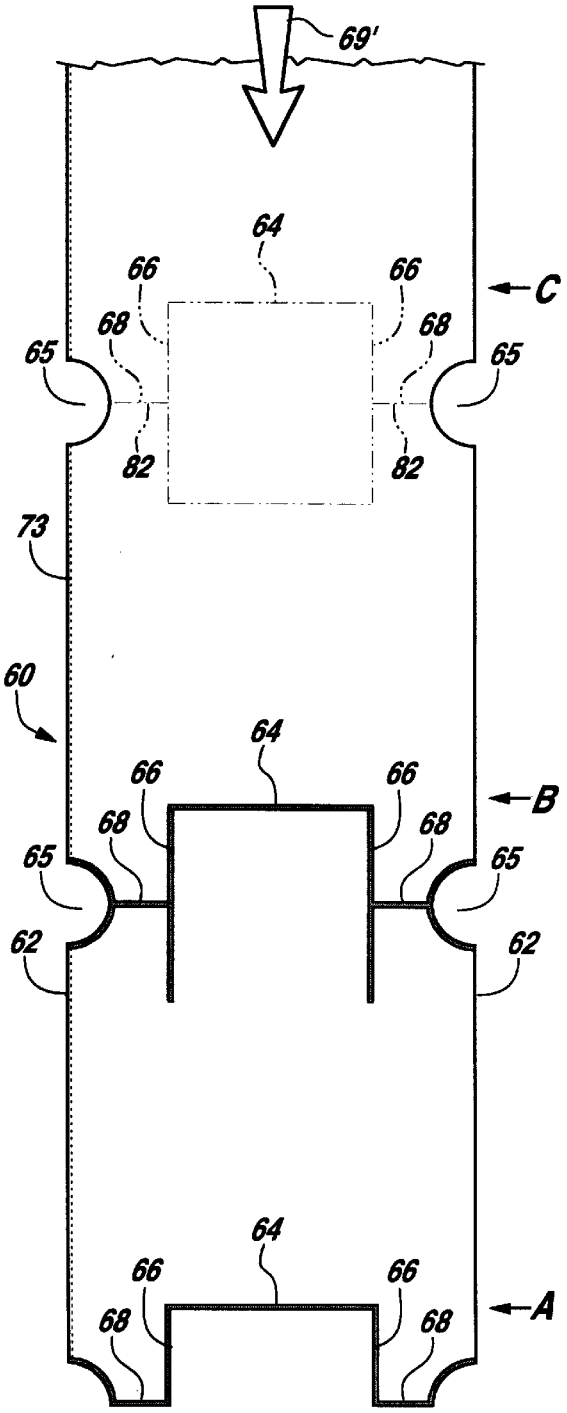
FIG. 26 is a diagrammatic illustrating the process of manufacturing a succession of bulk bag blanks formed from a tube having one longitudinal seam line.

FIG. 26 illustrates a variation of the bulk bag manufacturing process of FIG. 25. In accordance with the variation of the process illustrated in FIG. 26, a continuous length of woven polypropylene material is advanced along a path defined by the arrow 69'. However, rather than comprising a length of tubular woven polypropylene material, there is provided a single sheet of woven polypropylene material which is folded upon itself along the fold line 62' and is joined together at the opposite edges along a sew line 73. Other than the nature of the woven polypropylene material from which the bulk bag blanks are formed, the process of bulk bag manufacture according to FIG. 26 is identical to that of FIG. 25.

Figure 27:
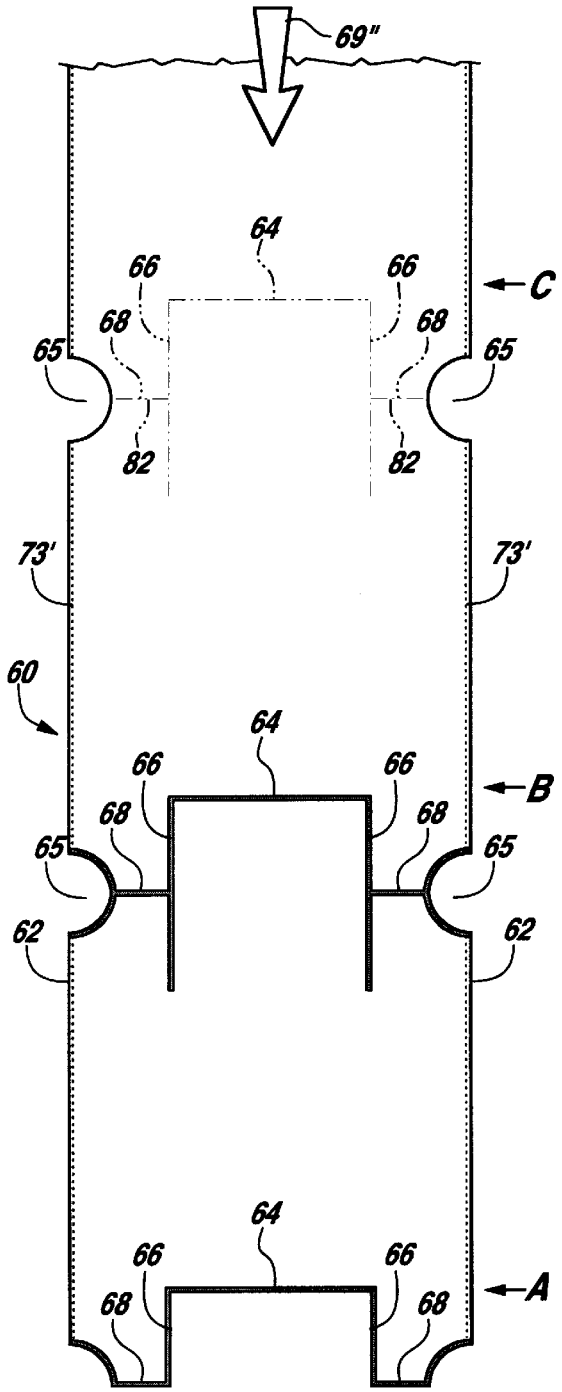
FIG. 27 is a diagrammatic illustrating the process of manufacturing a succession of bulk bag blanks formed from a tube having two longitudinal seam lines.

FIG. 27 illustrates a further variation of the process of bulk bag manufacture illustrated in FIG. 25. In accordance with the process of FIG. 27, woven polypropylene material is advanced along a path defined by the arrow 69". Rather than comprising tubular woven polypropylene material, the woven polypropylene material of FIG. 27 comprises two layers of woven polypropylene which are joined together along sew lines 73'. Other than the difference in the nature of the woven polypropylene material from which the bulk bag blanks are formed, the process for bulk bag manufacture of FIG. 27 is identical to that of FIG. 25.

Figure 29A:
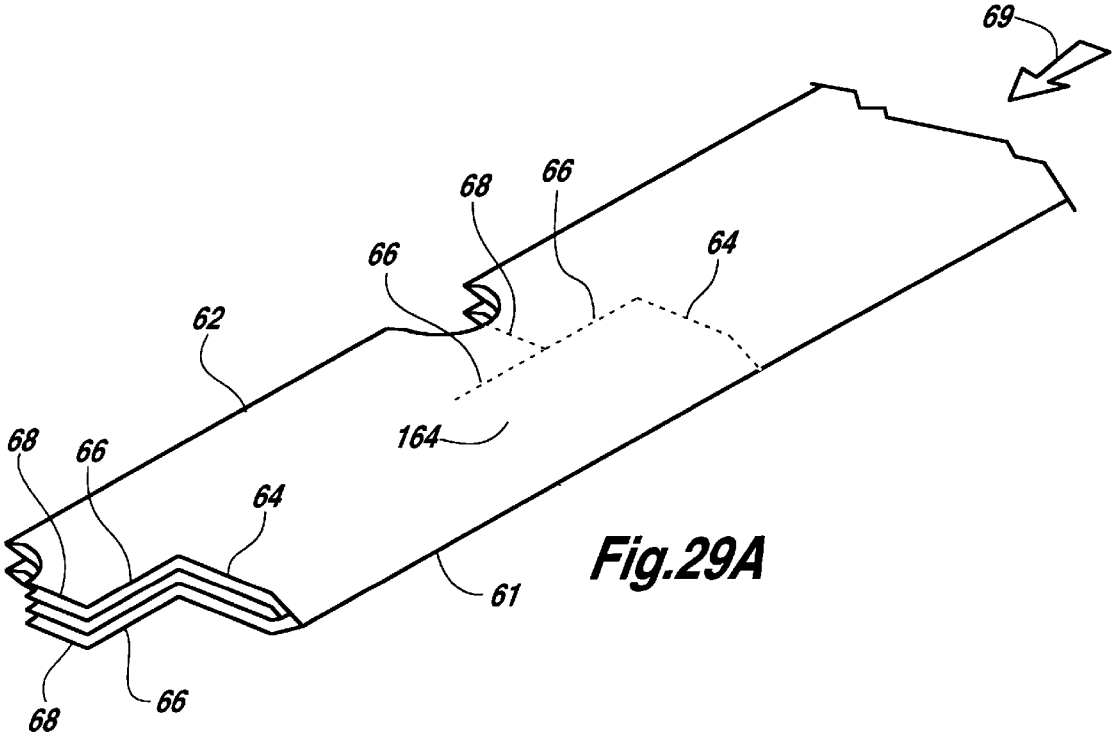
FIGS. 29A and 29B are diagrammatic illustrations of the process of manufacturing a succession of bulk bags of the present invention wherein the tube is folded in half longitudinally prior to cutting the successive blanks from the tube.

FIGS. 29A and 30–33 illustrate a variation in the method of manufacturing the bulk bag of the present invention. FIG. 29A illustrates a continuous tube folded in half about its longitudinal axis 61 forming a continuous tube of four fabric layers.

Figure 30:
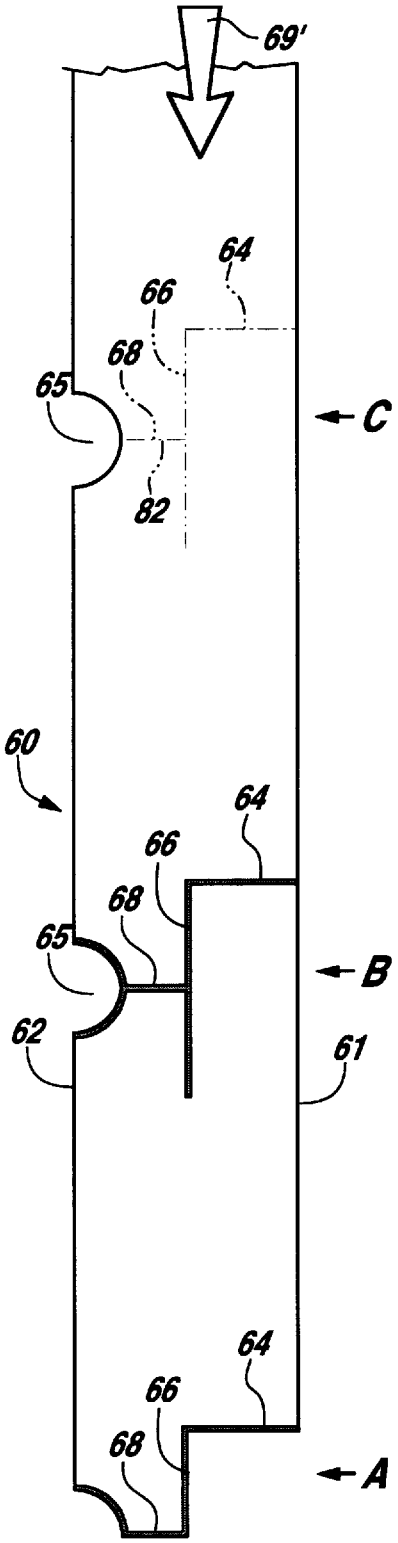
FIGS. 30–33 are diagrammatic illustrations of the process of manufacturing a succession of bulk bags of the present invention wherein the tube is folded in half longitudinally as illustrated in FIGS. 29A and 29B prior to cutting the successive blanks from the tube.

Referring now to FIG. 30, the continuous tube is advanced along a path defined by the arrow 69. Zone A comprises the leading end of a first bulk bag blank comprising previously formed cuts extending along the lines 64, 66 and 68. Zone B defines the trailing end of the first bulk bag blank and the leading end of a second bulk bag blank comprising just-completed cuts extending along the lines 64, 66, 68. Zone C defines the trailing end of the second bulk bag blank and the leading end of a third bulk bag blank comprising yet-to-be-formed cuts extending along the lines 64, 66, 68. Thus, it will be understood that the process of bulk bag manufacture comprising the present invention produces a succession of bulk bag blanks while generating a minimal amount of scrap material.

Figure 31:
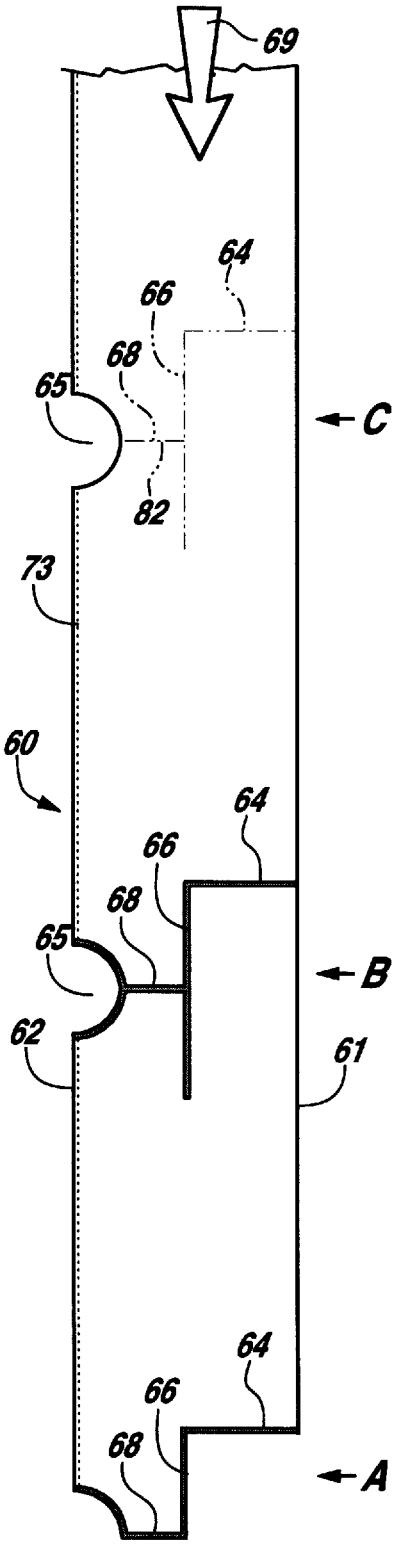

FIG. 31 illustrates a variation of the bulk bag manufacturing process of FIG. 30. In accordance with the variation of the process illustrated in FIG. 31, a continuous length of woven polypropylene material is advanced along a path defined by the arrow 69'. However, rather than comprising a length of tubular woven polypropylene material, there is provided a single sheet of woven polypropylene material which is folded upon itself along the fold line 62' and is joined together at the opposite edges along a sew line 73 and then folded along the longitudinal centerline 61 of the tube. Other than the nature of the woven polypropylene material from which the bulk bag blanks are formed, the process of bulk bag manufacture according to FIG. 31 is identical to that of FIG. 30.

Figure 32:
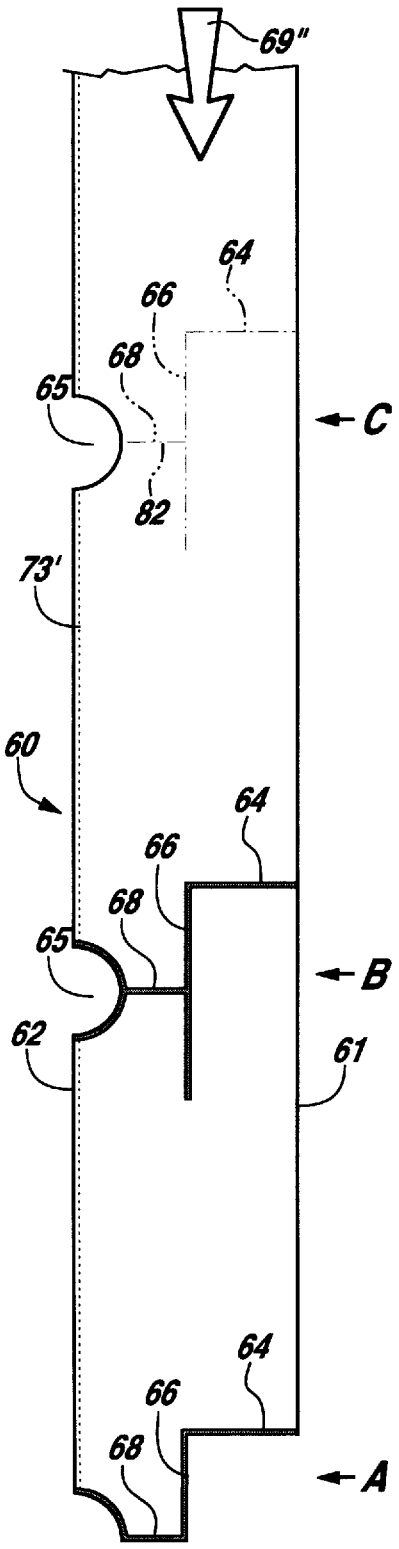

FIG. 32 illustrates a further variation of the process of bulk bag manufacture illustrated in FIG. 25. In accordance with the process of FIG. 32, woven polypropylene material is advanced along a path defined by the arrow 69". Rather than comprising tubular woven polypropylene material, the woven polypropylene material of FIG. 32 comprises two layers of woven polypropylene which are joined together along sew lines 73'. Other than the difference in the nature of the woven polypropylene material from which the bulk bag blanks are formed, the process for bulk bag manufacture of FIG. 32 is identical to that of FIG. 30.

Figure 6:
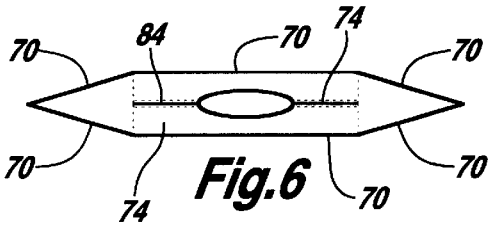
FIG. 6 is an illustration of later steps in the process of manufacturing the bulk bag of the present invention.

Referring again to FIG. 5, the foregoing procedures of FIGS. 25–32 form a blank for the bulk bag 60 comprising sidewall portions 70 and 70', unconnected top wall halves 72, unconnected bottom wall halves 74 and lift sleeve portions 76. The next step in the fabrication of the bulk bag 60 comprises joining the top wall halves one to the other. This is preferably accomplished by sewing or stitching the top wall halves together along sew line 82. Likewise, the bottom wall halves 74 are joined one to the other preferably by sewing or stitching the bottom wall halves 74 one to the other along sew line 84. The result of this procedure is illustrated in FIG. 6 which shows the bottom wall halves 74 joined together along the sew lines 84 to form the bottom wall of the bulk bag 60.

Figure 7:
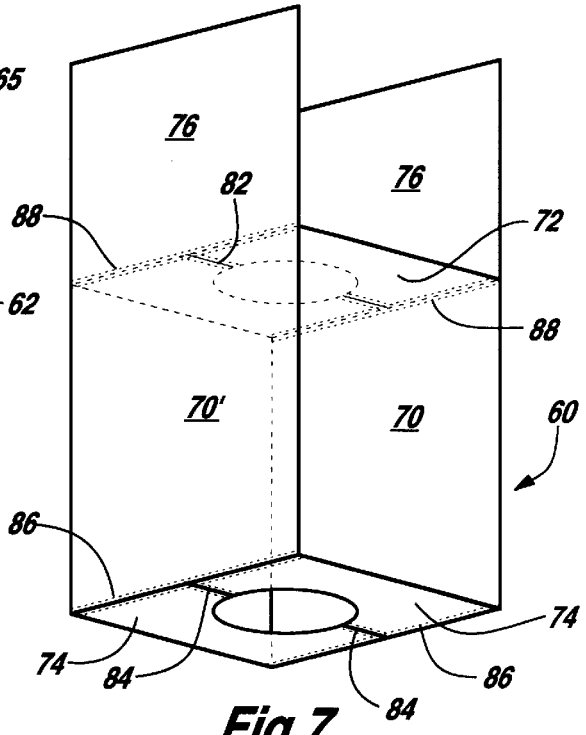
FIG. 7 is an illustration of still later steps in the process of manufacturing the bulk bag of the present invention.

The next steps of the process for manufacturing the bulk bag 60 of the present invention are illustrated in FIG. 7. The blank comprising the bulk bag 60 is manipulated into a rectangular configuration whereupon the peripheral edges of the side panels 70' are joined to the peripheral edges of the bottom wall halves 74, preferably by sewing or stitching along sew lines 86. Likewise, the top wall halves 72 are joined to the sidewalls 70' by sewing or stitching along sew lines 88.

Figure 8:
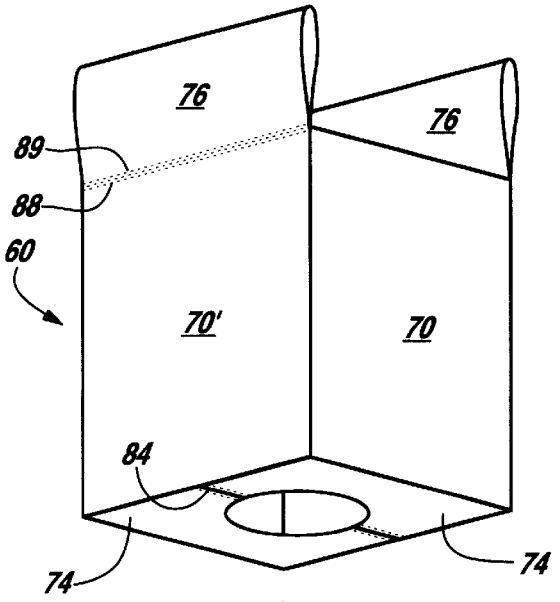
FIGS. 8 and 9 are illustrations of the final steps in the process of manufacturing a first embodiment of the bulk bag of the present invention.
Figure 9:
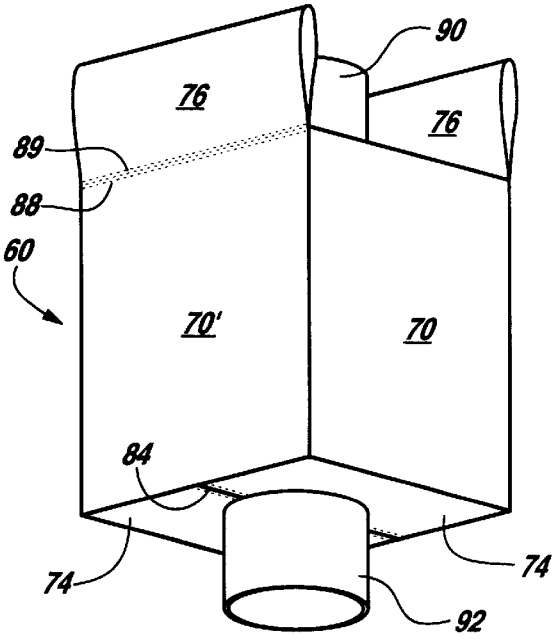

FIGS. 8 and 9 illustrate the completion of the bulk bag 60 to form a first embodiment thereof. The lift sleeve portions 76 are folded, and the distal ends thereof are secured by sew lines 89 adjacent to the sew lines 88, preferably by sewing or stitching. In this manner there is formed lift sleeves of the type well known in the bulk bag art which are adapted to receive forklift tines to facilitate the lifting and transport of the bulk bag 60 and the contents thereof. In actual practice, the distal ends of the lift sleeve portions 76 may be secured in place at the same time that the top wall halves 72 are joined to the sidewalls 70' by means of two identical sewing or stitching operations, one on each side of the bulk bag 60.

As is shown in FIG. 9, the bulk bag 60 may be completed by the installation of a top chute 90, also referred to in the art as a fill chute. The bulk bag 60 may also be provided with a bottom chute 92, also referred to in the art as a discharge chute. When a fill chute is to be installed, a quarter circle opening 65 is cut in the distal edge of each opposed top wall half 72 of the tubular blank, wherein when the blank is unfolded and the top wall is assembled the quarter circle openings mate to form a circular opening for receiving the fill chute. In a similar manner when a discharge chute is to be installed a quarter circle opening 65 is cut in the distal edge of each opposed bottom wall half 74 of the tubular blank, wherein when the blank is unfolded and the top wall is assembled the quarter circle openings mate to form a circular opening for receiving the discharge chute. Alternatively, the bulk bag 60 may be provided with an open top configuration. Alternatively, the discharge chute 92 may be omitted entirely in which case the bottom of the bag 60 comprises a plain bottom, also known as a solid bottom.

Figure 10:
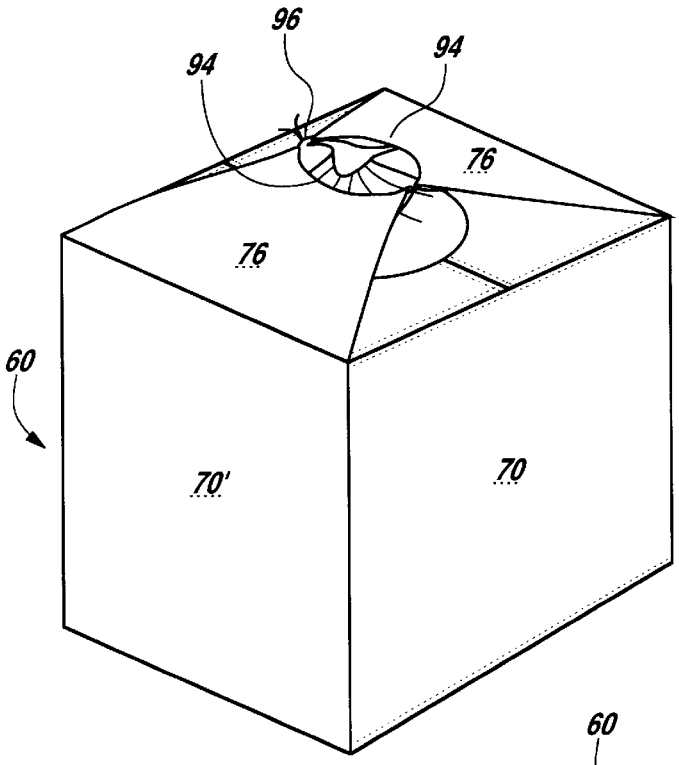
FIG. 10 is an illustration of a second embodiment of the process of manufacturing the bulk bag of the present invention.

FIG. 10 illustrates a bulk bag 60 comprising a second embodiment of the present invention. Rather than being folded over and joined to form lift sleeves, the distal ends of the lift sleeve portion 76 may be folded over and joined along sew lines 94 to form passageways for receiving a rope 96. The rope 96 may then be engaged by a hook or other conventional lifting apparatus to facilitate lifting and transport of the bulk bag 60.

Figure 11B:
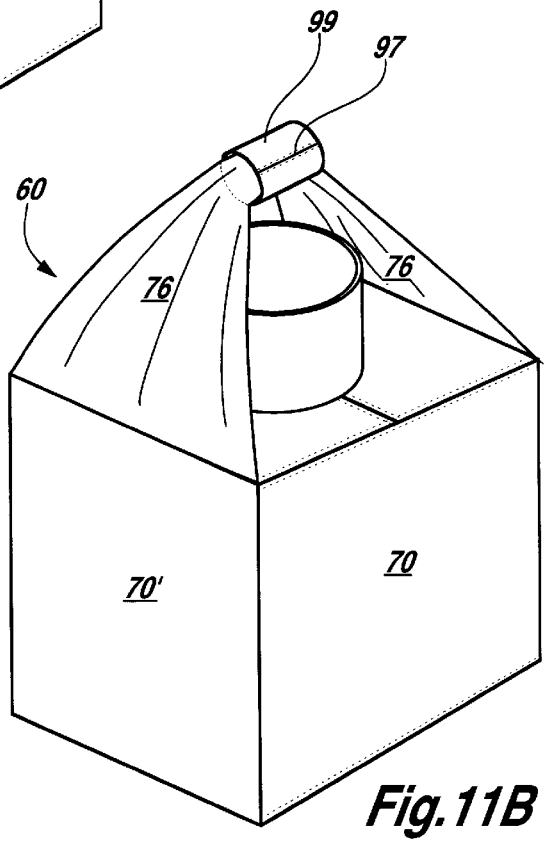
FIGS. 11A and 11B are illustrations of a first and second variation of a third embodiment of the process of manufacturing the bulk bag of the present invention.
Figure 11A:
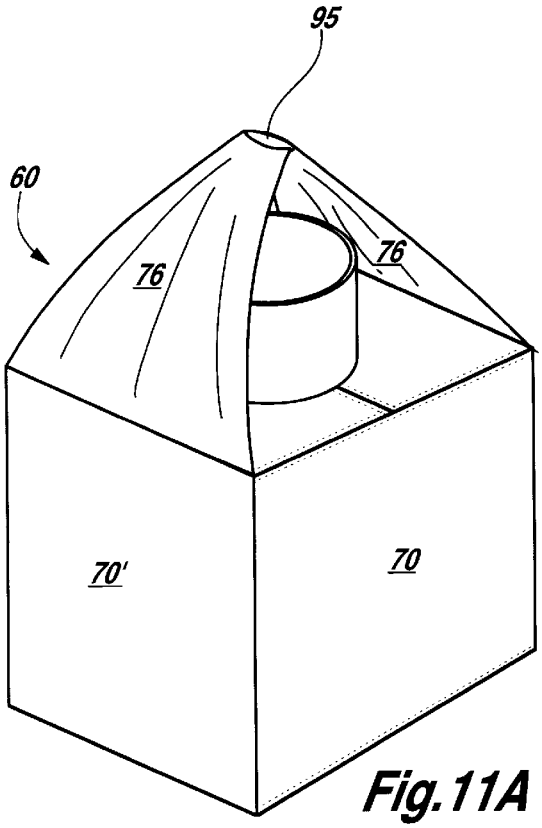

FIGS. 11A and 11B illustrate a first and second variation of a third embodiment of the bulk bag 60 of the present invention. Referring to FIG. 11A, in accordance with a first variation of the third embodiment, the distal ends of the lift sleeve portion 76 are gathered together and joined at upper ends 95 by means of sewing, stitching or other conventional means to provide a bulk bag having a single point lift configuration. Again, the embodiment of the bulk bag 60 illustrated in FIG. 11A is adapted to be lifted and transported by means of a hook or other conventional bulk bag lifting and transporting apparatus. Referring to FIG. 11B, in accordance with a second variation of the third embodiment, the distal ends of the lift sleeve portions 76 are next gathered together and joined at upper ends 95 by means of sewing, stitching or other conventional means. A tubular carrier sleeve 99 is disposed around joined ends of list sleeve portions 76. The carrier sleeve 99 may be formed from a rectangular sheet of fabric that is joined on its longitudinal edge by sew line 97 or, alternately, it may be a continuously woven tube. The sleeve 99 may also be formed by wrapping the formed ends of the lift sleeve portions with layers of fabric or film. Alternatively, the sleeve 96 may comprise a length of shrink wrap tubing which is tightly fitted around the joined lift sleeve portions 76 by heating. The embodiment of the bulk bag 60 illustrated in FIG. 11B is adapted to be lifted and transported by means of a hook or other conventional bulk bag lifting and transporting apparatus, wherein the carrier sleeve 99 provides additional strength and durability to the lift sleeve portions 76.

Figure 12A:
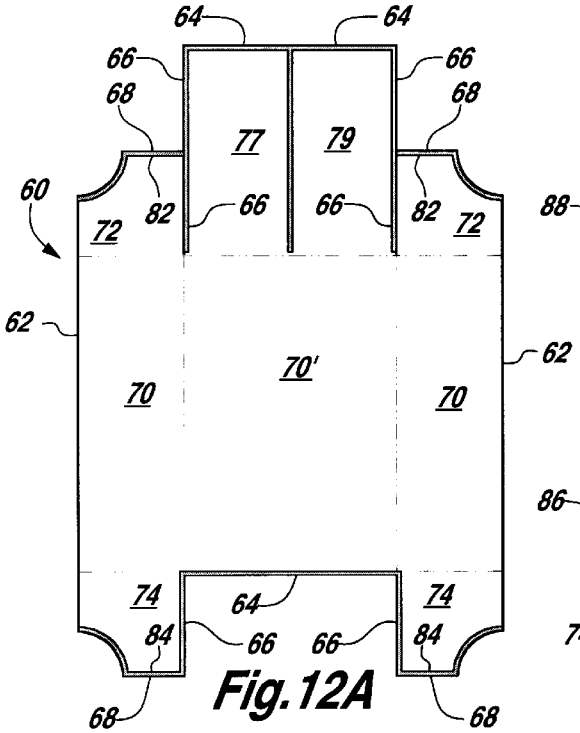
FIGS. 12A, 12B and 13 are an illustration of steps in the process of manufacturing a fourth embodiment of the bulk bag of the present invention.
Figure 12B:
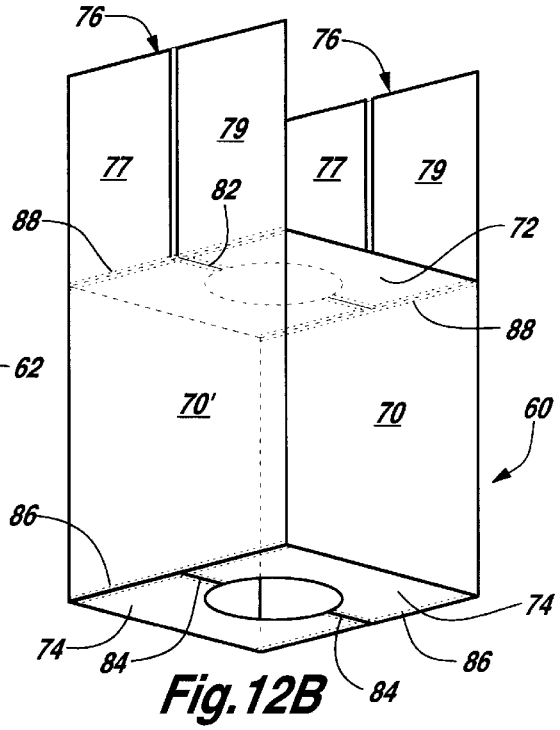
Figure 13:
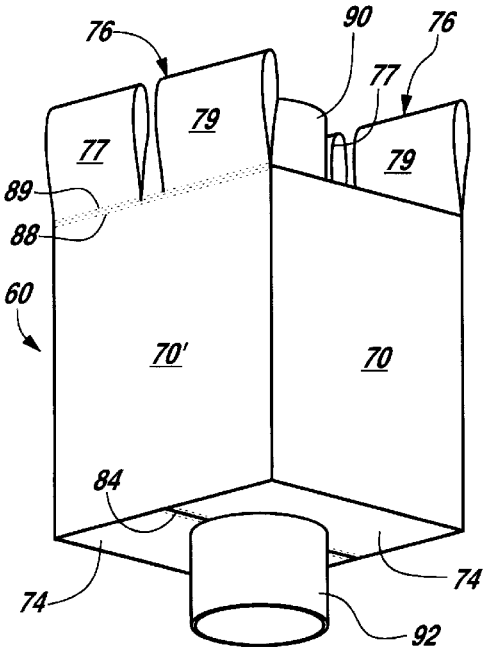

FIGS. 12 and 13 illustrate a fourth embodiment of the bulk bag 60 of the present invention. In accordance with the fourth embodiment, each lift sleeve portion 76 is slit longitudinally into two approximately equal portions, 77 and 79. The lift sleeve portions 77 and 79 are folded, and the distal ends thereof are secured by sew lines 89 adjacent to the sew lines 88, preferably by sewing or stitching. In this manner there is formed four identical lift sleeve s of the type well known in the bulk bag industry.

Figure 14:
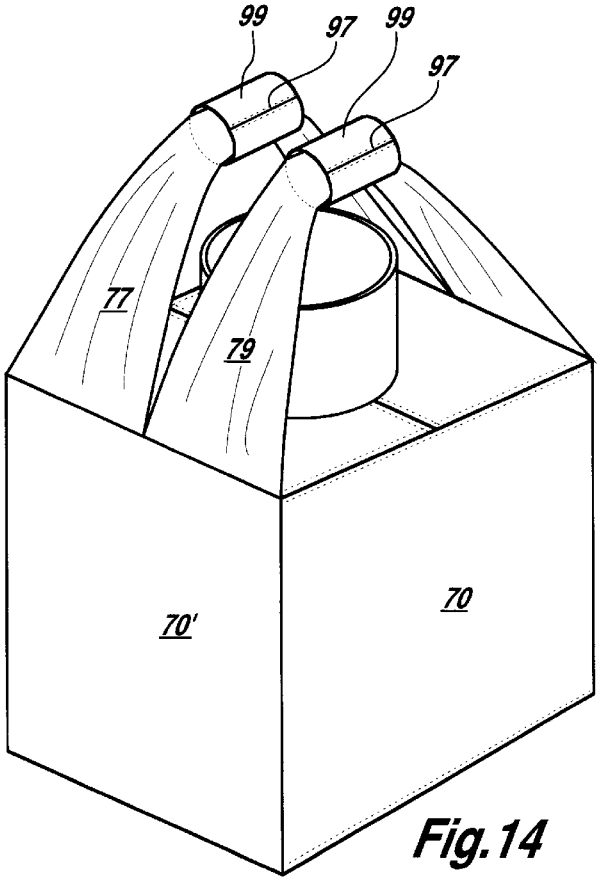
FIG. 14 is an illustration of a fifth embodiment of the process of manufacturing the bulk bag of the present invention.

FIG. 14 illustrates a fifth embodiment of the bulk bag 60 of the present invention. In accordance with the fifth embodiment, the lift sleeve portions are slit as shown in FIG. 12. The distal ends of the lift sleeve portions 77 are next gathered together and joined at upper ends 95 by means of sewing , stitching or other conventional means. The distal ends of the lift sleeve portions 79 are next gathered together and joined at upper ends 95 by means of sewing, stitching or other conventional means. As can be seen in FIG. 14, a tubular carrier sleeve 99 is disposed around the joined ends of lift sleeve portions 77 and 79. The carrier sleeve 99 may be formed from a rectangular sheet of fabric that is joined on its longitudinal edge by sew line 97 or, alternately, it may be a continuously woven tube. The sleeve 99 may also be formed by wrapping the formed ends of the lift sleeve portions with layers of fabric or film. Alternatively, the sleeve 96 may comprise a length of shrink wrap tubing which is tightly fitted around the joined lift sleeve portions 76 by heating. The embodiment of the bulk bag 60 illustrated in FIG. 14 is adapted to be lifted and transported by means of a hook or other conventional bulk bag lifting and transporting apparatus, wherein the carrier sleeve 99 provides additional strength and durability to the lift sleeve portions 77 and 79.

Figure 15:
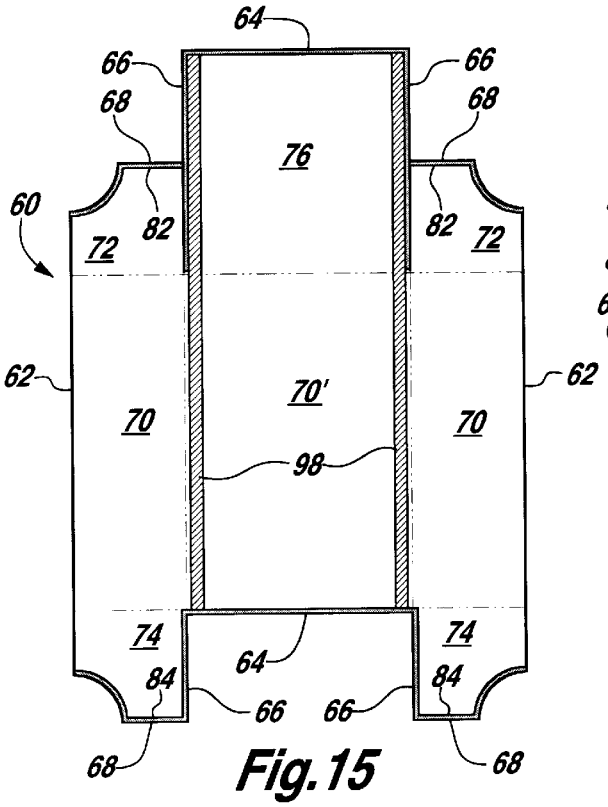
FIGS. 15 and 16 are an illustration of steps in the process of manufacturing a sixth embodiment of the bulk bag of the present invention.
Figure 16:
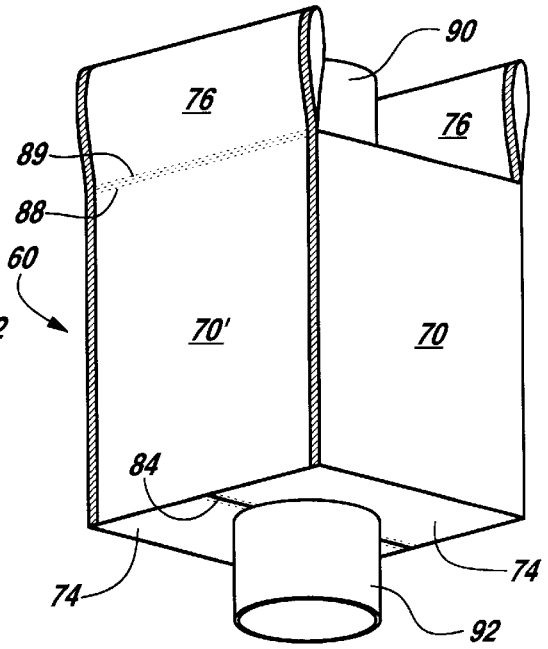

Referring now to FIG. 15, there is shown the first step in the process for manufacturing a bulk bag 60 comprising the sixth embodiment of the present invention and FIG. 16 illustrates the finished product thereof. The bulk bag 60 is formed from a length of tubular material having woven strips of higher density fiber count sections 98 extending longitudinally along the tubular material from which blank 70 is formed. Higher density fiber count weaving increases the strength of the fabric in the areas of the higher density weaving. Alternatively, stronger fibers may be used in weaving the strips, thereby accomplishing strips of higher strength fabric. "Higher strength strips" is used hereinafter to refer to both strips of higher strength fiber count and strips of higher strength fibers. The higher strength strips are positioned in the tubular blank 70 such that when the bag 60 is formed by the method as was previously described in detail with regard to FIGS. 5–9, the higher strength strips 98 are positioned at the corners of the bag 60 and its associated lift sleeves 76, thereby providing additional strength and stability to bag 60.

Figure 17:
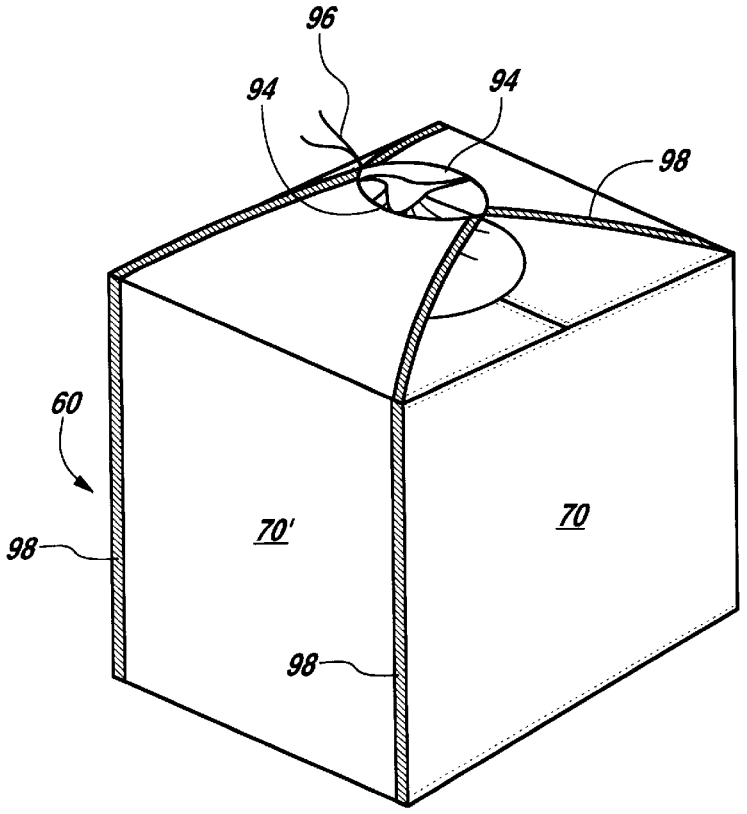
FIG. 17 is an illustration of a seventh embodiment of the process of manufacturing the bulk bag of the present invention.

FIG. 17 illustrates a seventh embodiment of the bag 60 previously described and illustrated in FIG. 10. As can be seen in FIG. 17, higher strength strips 98 are positioned at the corners and the bag 60, thereby providing additional strength and stability to the bag as was described with regard to FIGS. 15 and 16.

Figure 18:
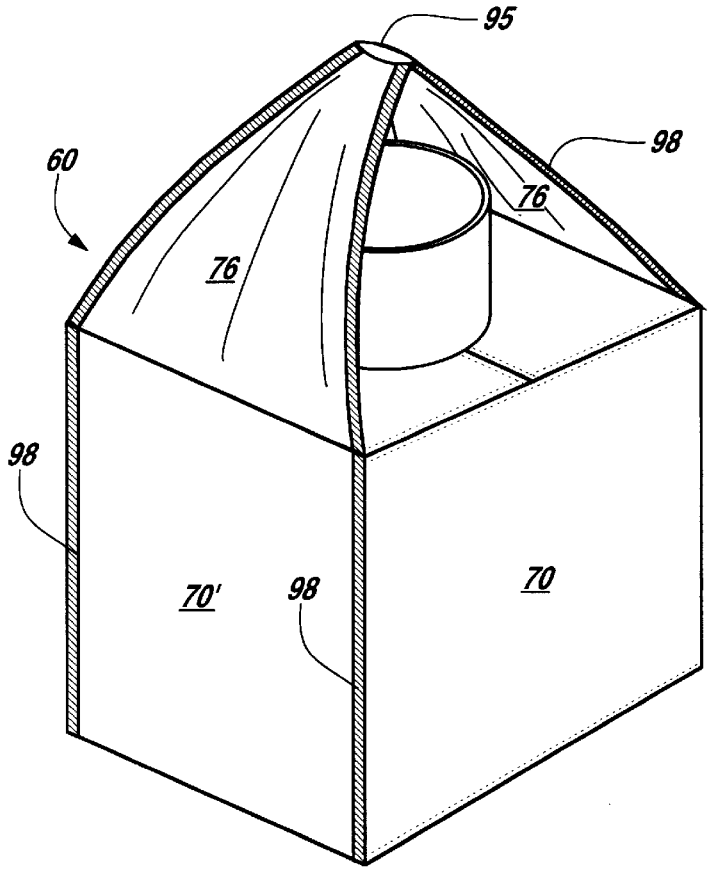
FIG. 18 is an illustration of an eighth embodiment of the process of manufacturing the bulk bag of the present invention.

FIG. 18 illustrates an eighth embodiment of the bag 60 previously described and illustrated in FIG. 11A. As can be seen in FIG. 18, higher strength strips 98 are positioned at the corners of the bag 60, thereby providing additional strength and stability to the bag 60 as was described in FIGS. 15 and 16.

Figure 19:
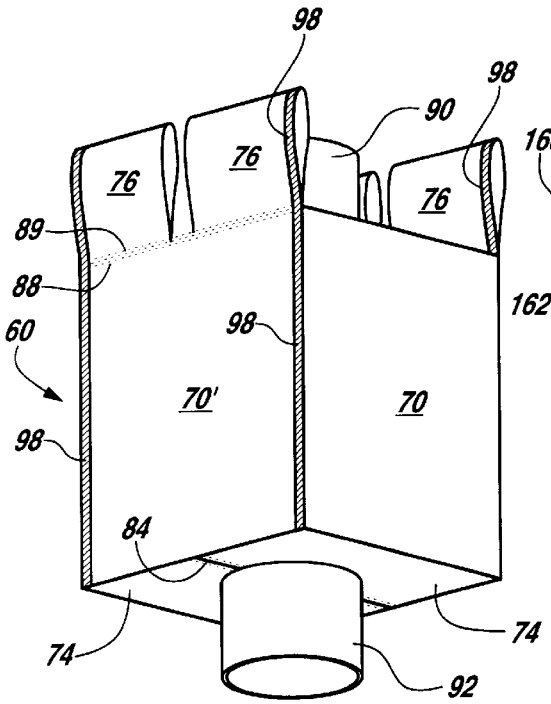
FIG. 19 is an illustration of a ninth embodiment of the process of manufacturing the bulk bag of the present invention.

FIG. 19 illustrates a ninth embodiment of the bag 60 previously described and illustrated in FIG. 13. As can be seen in FIG. 19, higher strength strips 98 are positioned at the corners of the bag 60, thereby providing additional strength and stability to the bag 60 as was described in FIGS. 15 and 16.

Figure 20:
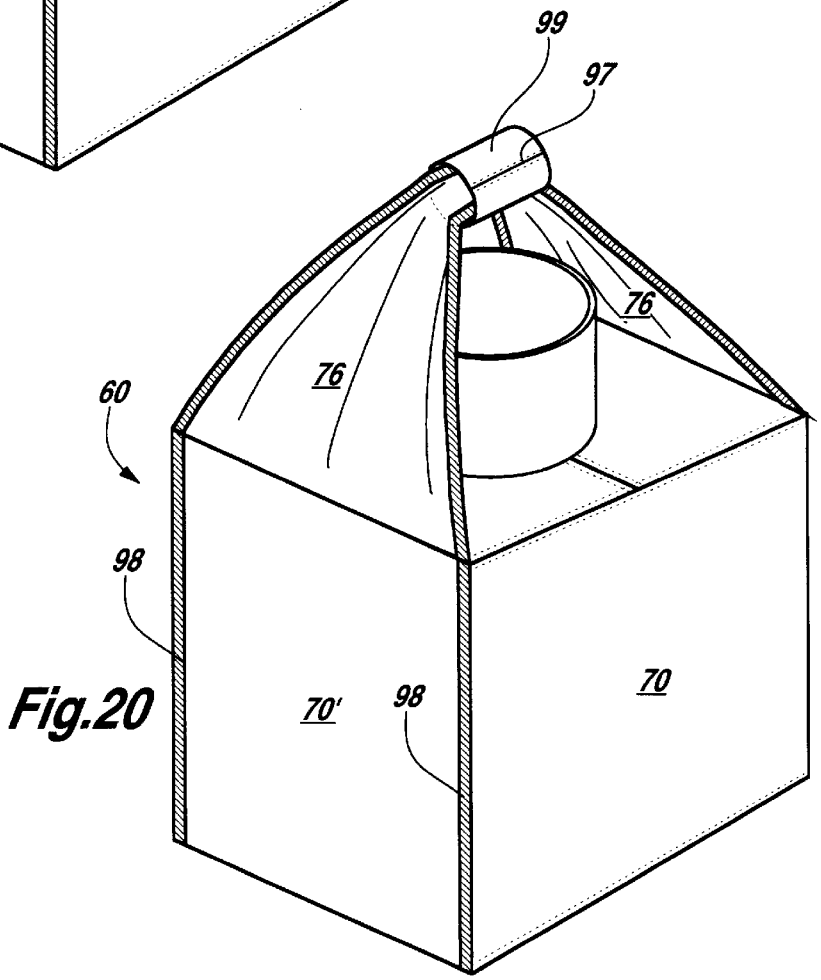
FIG. 20 is an illustration of a tenth embodiment of the process of manufacturing the bulk bag of the present invention.

FIG. 20 illustrates an tenth embodiment of the bag 60 previously described and illustrated in FIG. 14. As can be seen in FIG. 20, higher strength strips 98 are positioned at the corners and the bag 60, thereby providing additional strength and stability to the bag as was described with regarding to FIGS. 15 and 16.

Figure 21:
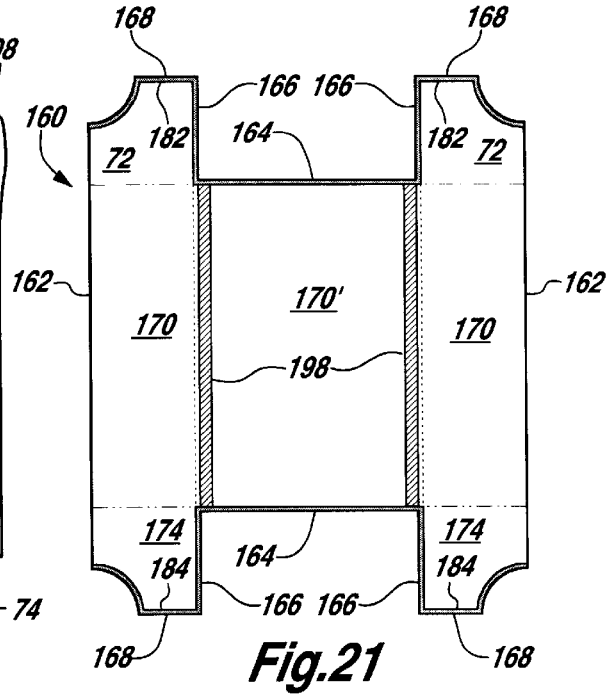
FIG. 21 is an illustration of initial steps in the process of manufacturing an eleventh embodiment of the bulk bag of the present invention.

Referring now to FIG. 21, there is shown the first steps of a process for manufacturing an eleventh embodiment of the bulk bag 160 comprising the present invention. The bulk bag 160 is preferably formed from a length of tubular material, preferably woven polypropylene material. The length of tubular material comprising the bulk bag 160 may conveniently be formed on a circular loom; however, it will be understood that other methods for manufacturing the length of tubular material may be employed in the practice of the invention, if desired. The tubular material may be formed by sewing two sheets of rectangular shaped fabric to one another along their longitudinal edges as previously illustrated in FIG. 26. Alternatively, a single piece of fabric may be folded in half and the longitudinal edges sewn to one each other as previously illustrated in FIG. 27.

The process for manufacturing the bulk bag 160 of the present invention begins by laying the length of tubular material flat. Thus, the length of tubular material comprises two layers, one positioned on top of the other, which are joined together along lines 162 comprising folds in the fabric of the tubular material. Next, the length of tubular material is laser cut along transverse lines 164, longitudinal lines 166 and substantially transverse lines 168. Next, the length of tubular material is laser cut along transverse lines 163 to form the configuration illustrated in FIG. 21. Those skilled in art will appreciate the fact that by making the cuts 163, 164, 166 and 168, the length of tubular material is automatically formed into successive blanks, each comprising one bulk bag 160 incorporating the present invention. Those skilled in the art will appreciate that various known and unknown methods of cutting which may be used in the practice of the present invention. Such methods may include, but are not limited to, laser cutting, die cutting, hot cutting, cold roller cutting and ultra-sonic cutting.

Figure 28:
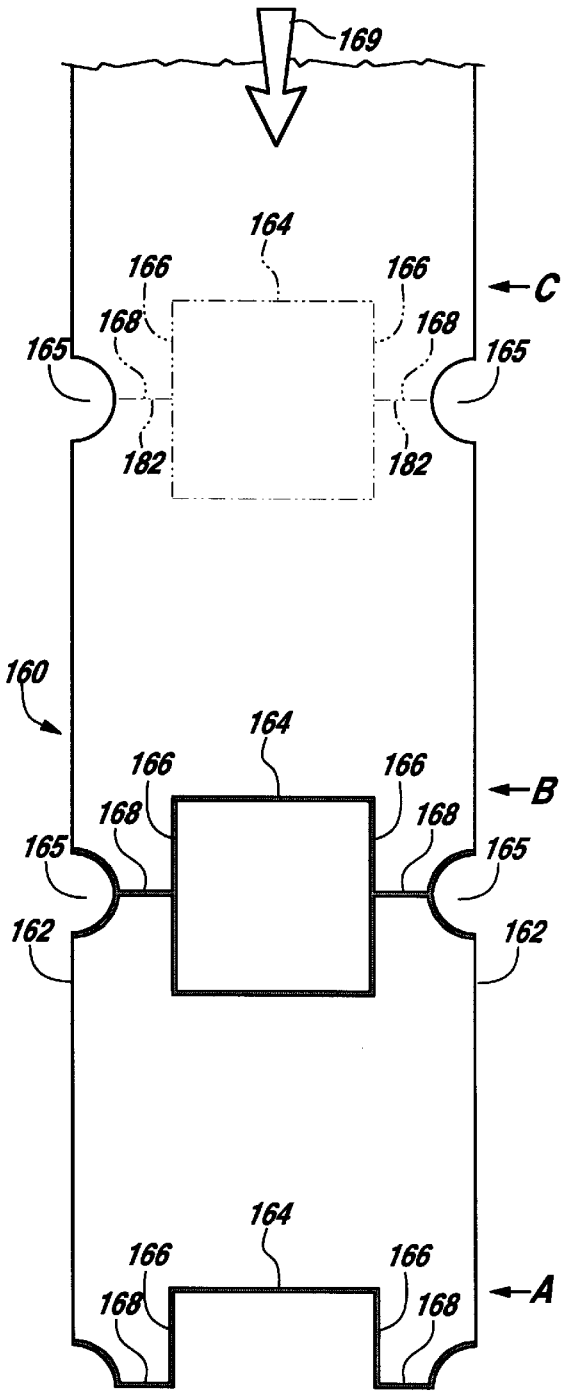
FIG. 28 is a diagrammatic illustrating the process of manufacturing a succession of bulk bags of the embodiment depicted in FIGS. 21–24.

The foregoing procedures are further illustrated in FIG. 28. A continuous length of tubular woven polypropylene material formed, for example, on a circular loom, is advanced along a path defined by the arrow 169. Zone A comprises previously formed cuts extending along the lines 164, 166 and 168. Zone B defines the trailing end of the first bulk bag blank and the leading end of a second bulk bag blank comprising just-completed cuts extending along the lines 164, 166, and 168. Zone C defines the trailing end of the second bulk bag blank and the leading end of a third bulk bag blank comprising yet-to-be formed cuts extending along the lines 164, 166 and 168. Thus it will be understood that the process of bulk bag manufacture comprising the present invention produces a succession of bulk bag blanks while generating a minimal amount of scrap material.

Figure 29B:
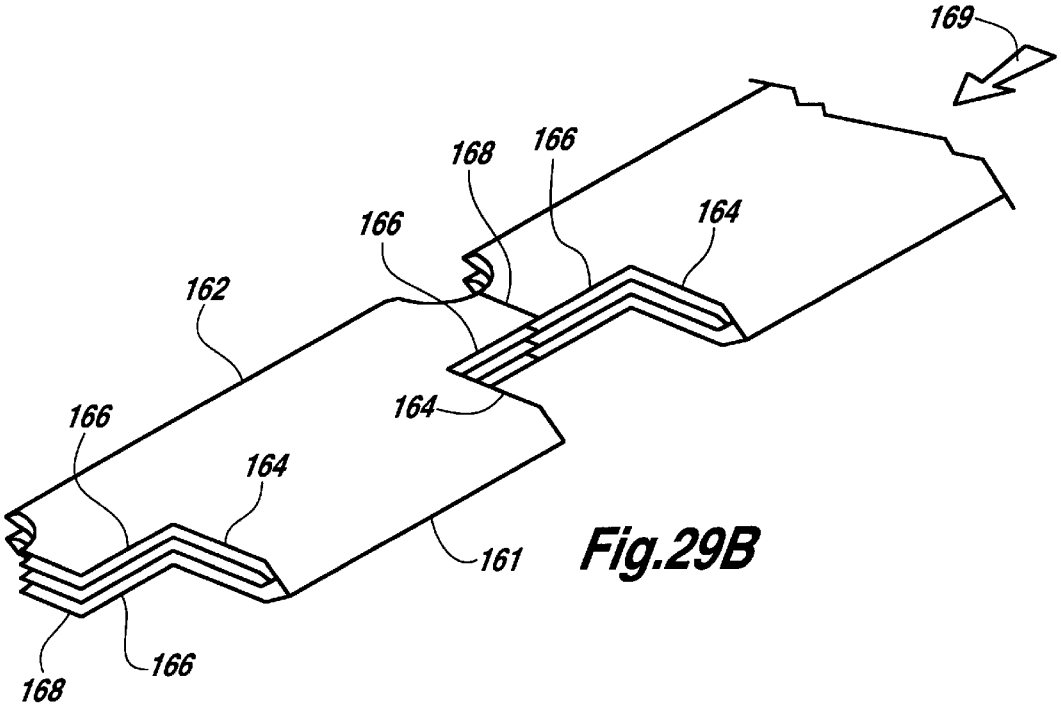
Figure 33:
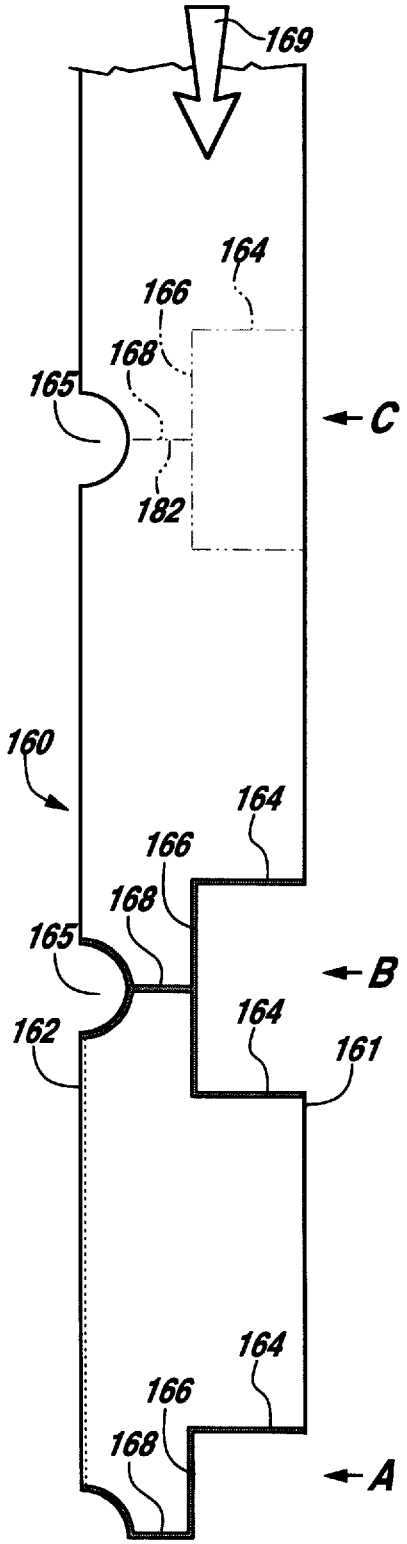

Referring to FIGS. 29B and 33, a variation in the process of manufacturing the bulk bag 160 of the present invention begins by laying the length of tubular material flat and folding the tube in half about its longitudinal axis 161. Thus, the length of tubular material comprises four layers, each positioned on top of the other.

Referring now to FIG. 33, the length of tubular woven polypropylene material formed, for example, on a circular loom, is advanced along a path defined by the arrow 169. Zone A comprises previously formed cuts extending along the lines 163, 164, 166 and 168. Zone B defines the trailing end of the first bulk bag blank and the leading end of a second bulk bag blank comprising just-completed cuts extending along the lines 163, 164, 166, and 168. Zone C defines the trailing end of the second bulk bag blank and the leading end of a third bulk bag blank comprising yet-to-be formed cuts extending along the lines 163, 164, 166 and 168. Thus it will be understood that the process of bulk bag manufacture comprising the present invention produces a succession of bulk bag blanks while generating a minimal amount of scrap material.

The foregoing procedures of FIGS. 28, 29B and 33 form a blank for the bulk bag 160 comprising sidewall portions 170 and 170', unconnected top wall halves 172, and unconnected bottom wall halves 174 It will be noted that no lift sleeve portions 76 are present as are contained in the embodiments of the invention illustrated in FIGS. 5–20.

Figure 22:
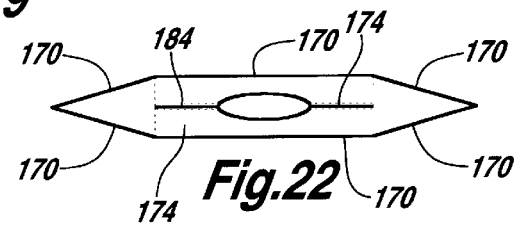
FIG. 22 is an illustration of later steps in the process of manufacturing the eleventh embodiment of the bulk bag of the present invention.

The next step in the fabrication of the bulk bag 160 comprises joining the top wall halves one to the other. This is preferably accomplished by sewing or stitching the top wall halves together along sew line 182. Likewise, the bottom wall halves 174 are joined one to the other preferably by sewing or stitching the bottom wall halves 174 one to the other along sew line 184. The result of this procedure is illustrated in FIG. 22 which shows the bottom wall halves 174 joined together along the sew lines 184 to form the bottom wall of the bulk bag 160.

Figure 23:
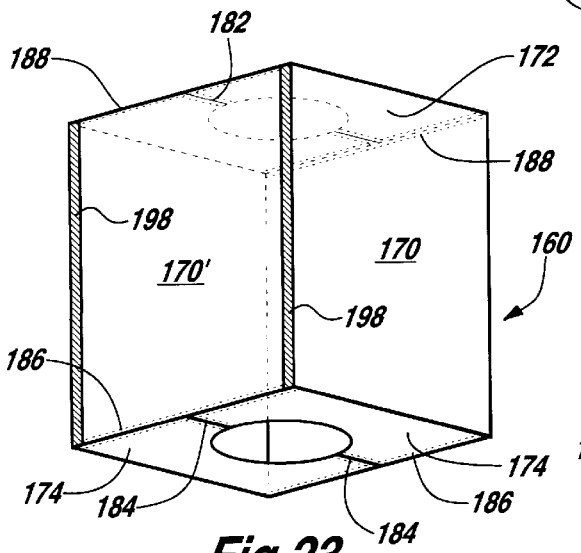
FIG. 23 is an illustration of later steps in the process of manufacturing the eleventh embodiment of the bulk bag of the present invention.

The next steps of the process for manufacturing the bulk bag 160 of the present invention are illustrated in FIG. 23. The blank comprising the bulk bag 160 is manipulated into a rectangular configuration whereupon the peripheral edges of the side panels 170' are joined to the peripheral edges of the bottom wall halves 174, preferably by sewing or stitching along sew lines 186. Likewise, the top wall halves 72 are joined to the sidewalls 170' by sewing or stitching along sew lines 188.

Figure 24:
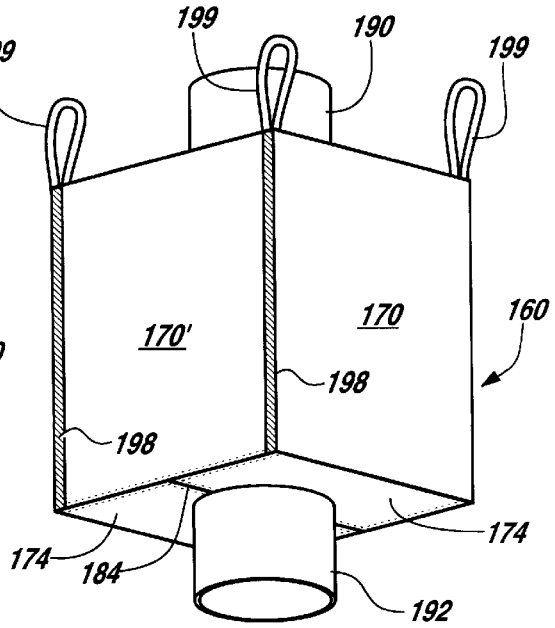
FIG. 24 is an illustration of the final steps in the process of manufacturing the eleventh embodiment of the bulk bag of the present invention.

FIG. 24 illustrates the completion of the bulk bag 160 to form the tenth embodiment thereof. Conventional lift loops 199 formed from woven or knitted polypropylene fabric webbing are sewn at the upper corners of bag 160. In this manner there is formed lifting loops 199 of the type well-known in the bulk bag art which are adapted to receive forklift tines or lifting hooks to facilitate the lifting and transport of the bulk bag 160 and the contents thereof.

As is shown in FIG. 24, the bulk bag 160 may be completed by the installation of a top chute 190, also referred to in the art as a fill chute. The bulk bag 160 may also be provided with a bottom chute 192, also referred to in the art as a discharge chute. When a fill chute is to be installed, a quarter circle opening 165 is cut in the distal edge of each opposed top wall half 172 of the tubular blank, wherein when the blank is unfolded and the top wall is assembled the quarter circle openings mate to form a circular opening for receiving the fill chute. In a similar manner when a discharge chute is to be installed a quarter circle opening 165 is cut in the distal edge of each opposed bottom wall half 174 of the tubular blank, wherein when the blank is unfolded and the top wall is assembled the quarter circle openings mate to form a circular opening for receiving the discharge chute. Alternatively, the bulk bag 160 may be provided with an open top configuration. Alternatively, the discharge chute 192 may be omitted entirely in which case the bottom of the bag 160 comprises a plain bottom, also known as a solid bottom. Higher strength strips 198 may be positioned at the corners and the bag 160, thereby providing additional strength and stability to the bag as was described with regarding to FIGS. 15 and 16.

Figure 34:
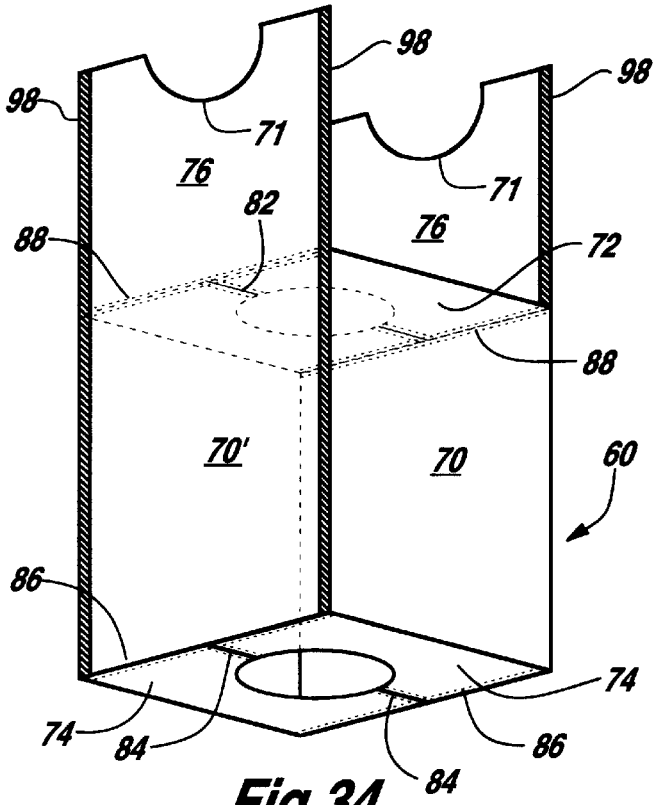
FIGS. 34 and 35 are illustrations of a twelfth embodiment of the process of manufacturing a bulk bag of the present invention.
Figure 35:
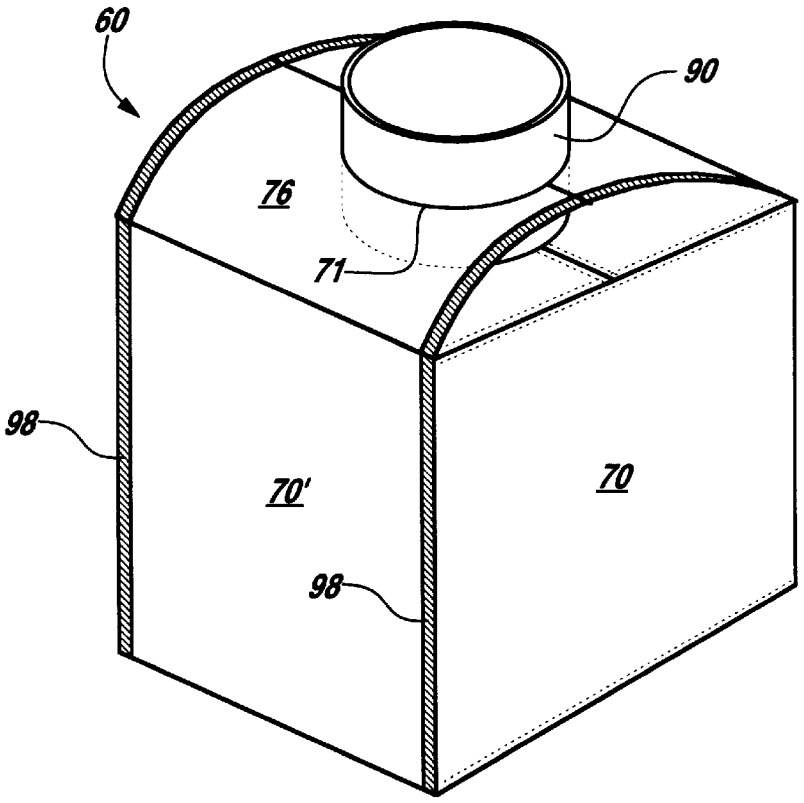

FIGS. 34 and 35 illustrate a twelfth embodiment of the bulk bag of the present invention. In accordance with the twelfth embodiment, each lift sleeve portion 76 has a half circle 71 cut from the distal end of each lift sleeve portion 76. The diameter of the half circle is substantially the same as the diameter of the fill chute 90. The lift sleeve positions of 76 are folded toward one another and the distal ends secured together by sewing and stitching. Half circles 71 mate to form a circular opening of substantially the same diameter as the fill chute 90, thereby allowing the fill chute 90 to be positioned through the lift sleeve 76. Higher strength strips 98 may be positioned at the corners of the bag 60 thereby providing additional strength and stability to the bag as was described with regard to FIGS. 15 and 16.

Although preferred and alternate embodiments have been illustrated in the drawings and described hereinabove, it will be understood that the invention is not limited to the embodiments disclosed, but is capable of numerous rearrangements, modifications and substitutions of parts and elements without departing from the spirit of the invention.

We claim:

1. A flexible intermediate bulk container comprising:

a flattened fabric tubular blank including:

a sidewall, a top end defined by a first transversely extending cut line that intersects longitudinally extending cut lines to form opposed lift sleeve portions and second transversely extending cut lines that are spaced apart by said first transversely extending cut line and intersect each of the longitudinally extending cut lines to form opposed top wall halves, and a bottom end defined by transversely extending cut lines that intersect longitudinally extending cut lines to form opposed bottom wall halves;

lift sleeves formed by folding each lift sleeve portion over and securing the distal end of each lift sleeve portion to the proximal end;

a top formed by folding the opposed top wall halves toward each other, securing the distal ends to each other, and securing the edge of the opposed top wall halves to the sidewall; and a bottom formed by folding the opposed bottom wall halves toward each other, securing the distal ends to each other, and securing the edges of the opposed bottom wall halves to the sidewall.

2. The flexible intermediate bulk container of claim 1 wherein the tubular blank is formed from a continuously woven fabric tube.

3. The flexible intermediate bulk container of claim 1 wherein the tubular blank is formed from two sheets of woven fabric, said sheets seamed together at their longitudinal edges to form a fabric tube.

4. The flexible intermediate bulk container of claim 1 wherein the tubular blank is formed from a single sheet woven fabric, said sheet seamed together at its longitudinal edges to form a fabric tube.

5. The flexible intermediate bulk container of claim 1 wherein the tubular blank further includes a plurality of longitudinally strips woven in said blank having an increased fiber count, said longitudinal strips for increased fabric strength.

6. The flexible intermediate bulk container of claim 1 wherein the tubular blank further includes a plurality of longitudinally woven strips in said blank having an increased fiber strength, said longitudinal strips for fabric strength.

7. The flexible intermediate bulk container of claim 1 further including a quarter circle opening cut in the distal end of each opposed top wall half of a flattened tubular blank, wherein when the flattened blank is unfolded and the top wall is assembled the quarter circle openings mate to form a circular opening in the assembled top wall, and a fill chute sewn into the circular opening of the top wall.

8. The flexible intermediate bulk container of claim 1 further including a quarter circle opening cut in the distal end of each opposed bottom wall half, wherein when the flattened blank is unfolded and the top is assembled, the quarter circle openings mate to form a circular opening in the assembled bottom wall, and a discharge chute is sewn into the circular opening of the bottom wall.

9. A method of manufacturing a flexible intermediate bulk container comprising:

providing a fabric tube;

cutting the fabric tube along a first transversely extending cut line and cutting a pair of longitudinally extending cut line that intersect the first transversely extending cut lines to form opposed lift sleeve portions;

cutting second transversely extending cut lines that intersect the midportion of each of the longitudinally extending cut lines to form opposed top wall halves of a first bulk bag blank and opposed bottom wall halves of a succeeding bulk bag blank;

forming lift sleeves by folding the lift sleeve portions of the top end over and securing the distal ends of the lift sleeve portions to the proximal end; and forming a top by folding the opposed top wall halves of the bulk bag blank toward each other, securing the distal ends to each other, and securing the edges of the opposed top wall halves to the sidewall; and forming a bottom by folding the opposed bottom wall halves of the bulk bag blank toward each other, securing the distal ends to each other, and securing the edges of the opposed bottom wall halves to the sidewall.

* * * * *

UNITED STATES PATENT AND TRADEMARK OFFICE

CERTIFICATE OF CORRECTION

PATENT NO. : 5,842,789 
DATED : December 1, 1998
INVENTOR(S) : Norwin C. Derdy, Craig A. Nickell and Bobby Glenn Brown It is certified that error appears in the above-identified patent and that said Letters Patent is hereby corrected as shown below:

Title page,
Item [75], Inventors, replace "Dennison" with -- Denison --.
Item [56], References Cited, FOREIGN PATENT DOCUMENTS, please add the following:

| | | |
|---|---|---|
| -- 139,383 | 5/1990 | Isotani |
| 5,270,547 | 10/1993 | Sekiguchi |
| 6,024,488 | 2/1994 | Sekiguchi |
| 4,300,891 | 7/1994 | Blumenkron -- |

Column 3,
Line 63, replace "54" with -- 52 --.

Column 4,
Line 16, delete the word "one".
Line 42, replace "Zone 2" with -- Zone B --.

Column 5,
Line 37, replace "longitudinal centerline" with -- longitudinal axis --.

Column 6,
Line 32, add a -- , -- after "installed".
Line 38, replace "discharge chute" with -- bottom chute --.
Line 64, replace "list" with -- lift --.

Column 7,
Line 3, replace "sleeve" with -- rope --.
Line 17, replace "sleeve s" with -- sleeves --.
Line 25, replace "sewing ," with -- sewing, --.
Line 36, replace "sleeve 96" with -- rope 96 --.
Line 50, replace "blank" with -- sidewall portion --.
Lines 60 and 66, replace "higher strength strips" with -- higher density fiber count sections --.
Line 67, replace "and" with -- of --.

UNITED STATES PATENT AND TRADEMARK OFFICE

CERTIFICATE OF CORRECTION

PATENT NO. : 5,842,789 
DATED : December 1, 1998
INVENTOR(S) : Norwin C. Derdy, Craig A. Nickell and Bobby Glenn Brown It is certified that error appears in the above-identified patent and that said Letters Patent is hereby corrected as shown below:

Column 8,
Lines 5, 11 and 17, replace “higher strength strips” with -- higher density fiber count sections --.
Line 15, replace “an tenth” with -- a tenth --.
Line 18, replace “corners and” with -- corners of --.
Line 20, replace “regarding” with -- regard --.
Lind 35, replace “one each” with --each --.
Line 52, delete “which”.

Column 9,
Line 28, add a -- . -- after “174”.

Column 10,
Line 2, add a -- , -- after “installed”.
Line 9, replace “discharge chute” with -- bottom chute --.
Line 12, replace “and the bag” with -- of the bag --.
Line 14, replace “regarding” with -- regard --.
Line 20, replace “fill chute” with -- bottom chute --.
Line 20, replace “positions” with -- portions --.
Line 24, replace “fill chute” with -- bottom chute -- in both instances.
Lines 25-26, replace “higher strength strips” with -- higher density fiber count sections --.

Column 12,
Line 7, replace “cut line that” with -- cut lines that --.

Signed and Sealed this

Thirtieth Day of November, 2004

JON W. DUDAS
*Director of the United States Patent and Trademark Office*